US010209024B2

(12) United States Patent
Kroyer

(10) Patent No.: US 10,209,024 B2
(45) Date of Patent: Feb. 19, 2019

(54) PRACTICE WEAPON

(71) Applicant: Glock Technology GmbH, Deutsch-Wagram (AT)

(72) Inventor: Josef Kroyer, Zemendorf (AT)

(73) Assignee: Glock Technology GmbH, Deutsch Wagram (AT)

( * ) Notice: Subject to any disclaimer, the term of this patent is extended or adjusted under 35 U.S.C. 154(b) by 238 days.

(21) Appl. No.: 15/399,633

(22) Filed: Jan. 5, 2017

(65) Prior Publication Data

US 2017/0191784 A1 Jul. 6, 2017

(30) Foreign Application Priority Data

Jan. 5, 2016 (EP) ..... 16150133

(51) Int. Cl.

| | |
|---|---|
| ***F41A 33/00*** | (2006.01) |
| ***F41A 3/66*** | (2006.01) |
| ***F41A 3/86*** | (2006.01) |
| ***F41A 5/02*** | (2006.01) |
| ***F41A 21/48*** | (2006.01) |
| ***F41C 3/00*** | (2006.01) |
| ***F41A 21/26*** | (2006.01) |
| *F41A 5/04* | (2006.01) |
| *F41A 5/06* | (2006.01) |

(52) U.S. Cl.

CPC ..... *F41A 33/00* (2013.01); *F41A 3/66* (2013.01); *F41A 3/86* (2013.01); *F41A 5/02* (2013.01); *F41A 21/26* (2013.01); *F41A 21/484* (2013.01); *F41A 21/488* (2013.01); *F41C 3/00* (2013.01); *F41A 5/04* (2013.01); *F41A 5/06* (2013.01)

(58) Field of Classification Search

CPC ..... F41A 33/00; F41A 33/02; F41A 33/04; F41A 33/06; F41A 5/02; F41A 5/04; F41A 5/06; F41A 21/26; F41A 21/484; F41A 21/488; F41C 3/00

See application file for complete search history.

(56) References Cited

U.S. PATENT DOCUMENTS

| | | | |
|---|---|---|---|
| 2,107,359 | A | 2/1938 | Altenburger |
| 2,817,174 | A | 12/1957 | Liedke |
| 3,745,881 | A | 7/1973 | Roy |
| 4,539,889 | A | 9/1985 | Glock |
| 4,825,744 | A | 5/1989 | Glock |
| 4,893,546 | A | 1/1990 | Glock |

(Continued)

FOREIGN PATENT DOCUMENTS

| | | |
|---|---|---|
| DE | 60003990 T2 | 6/2004 |

*Primary Examiner* — Timothy A Musselman
(74) *Attorney, Agent, or Firm* — Kolisch Hartwell, P.C.

(57) ABSTRACT

A practice weapon, having a conventional handle piece with a lock for a drop barrel, with a trigger mechanism which optionally has a rotary bearing for a rotatable trigger, with a spring base on which the return spring is supported; and with a practice breech with a fixed practice barrel. In order to permit a conversion without the use of a tool, an adapter is inserted into the handle piece, the adapter being supported firstly above the trigger mechanism, optionally above the rotary bearing, on a brace and secondly in the upper region of the spring base of the handle piece. Furthermore, the upper region of the adapter has guides for the practice barrel, and the lock interacts with a locking carriage, which is formed in a locking slot of the adapter, in such a manner that the locking carriage secures the practice barrel.

11 Claims, 6 Drawing Sheets

(56) References Cited

U.S. PATENT DOCUMENTS

Figure 1:
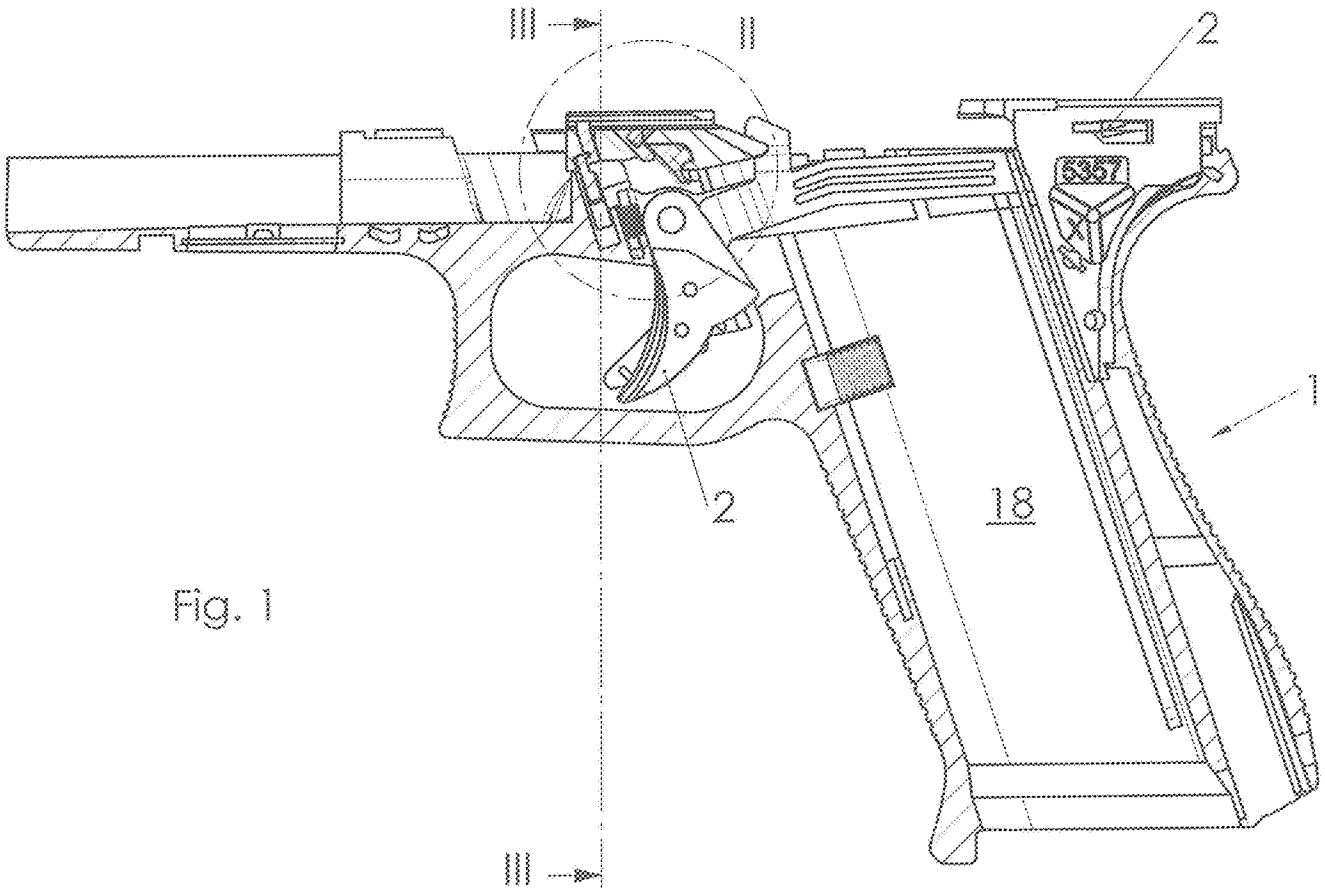

| | | | |
|---|---|---|---|
| 5,649,383 | A | 7/1997 | Wesp et al. |
| 6,276,252 | B1 | 8/2001 | Dionne |
| 6,357,331 | B1 | 3/2002 | Dionne |
| 7,823,314 | B1 | 11/2010 | Wheatley |
| 8,807,010 | B2 | 8/2014 | Bubits |
| 8,950,100 | B2 | 2/2015 | Nebeker et al. |
| 9,568,262 | B2 | 2/2017 | Bantle et al. |
| 2017/0191784 | A1 | 7/2017 | Kroyer |

PRACTICE WEAPON

The invention relates to a practice weapon which uses the frame of a conventional pistol, but makes use of a special breech and various adapters, in accordance with the preamble of claim 1.

It is known from DE 600 03 990 T2, corresponding to U.S. Pat. No. 6,357,331, to produce a practice weapon from a normal weapon by exchanging the barrel, wherein use is also made of a dedicated chamber part which can be inserted into the receiver through the injection port. Barrel and slide are no longer connected here, and the sequences of movement take place in a different manner than in the "genuine" weapon; despite the use of practice ammunition, there is a great deal of wear.

U.S. Pat. No. 2,817,174 relates to a "genuine" pistol, in which the barrel during normal use is positionally fixed with respect to the frame, and a form-fitting blockade pin which is displaceable counter to the force of a spring is provided for the removal along a dovetail guide. A conversion to a practice weapon is not envisaged.

The weapon according to U.S. Pat. No. 6,276,252 can be converted to a practice weapon, wherein the barrel is arranged in a fixed manner and provides a guide surface for the proper supply of the practice ammunition.

The content of the three US documents is incorporated by reference into the content of the present application in the jurisdictions in which this is possible.

For training purposes, use is customarily made of practice weapons which correspond as far as possible to the genuine weapons in terms of their handling and therefore in terms of the outer form, but also their mass, but visually, for example by special coloring, make confusion impossible so that each user already knows if he has a correct weapon or a practice weapon in front of him.

However, endeavors have been made for some time to use the conventional handle pieces, also called frames, in such practice weapons and only to interchange the slide or breech for a practice breech. Such an interchanging is absolutely necessary since practice weapons actually use ammunition which has only a minimum charge and therefore the customary breeches are not sufficiently moved by the action and reaction or the explosion gases. Jamming also repeatedly occurs even if there is sufficient recoil since the return spring has to be of weak design and it therefore repeatedly does not manage to draw or to plunge the next cartridge into the cartridge chamber as the slide advances.

It is the aim and object of the invention to specify a solution here through which it is possible without the use of a tool and therefore also outside a weapon chamber to undertake a corresponding conversion.

According to the invention, these aims are achieved by the features specified in the characterizing part of claim 1; in other words, in addition to a special slide together with a barrel which is fixed with respect to the frame and the return spring, the carriage, which prevents the forward movement of the barrel with the slide, which movement is necessary for dismantling, in the normal weapon, but does not prevent the backwards movement of the barrel after discharge of a shot, is changed by means of an adapter in such a manner that said carriage completely secures the barrel, since a fixed barrel is used for practice weapons. By means of this measure, it is possible to be able to use even ammunition having a weak charge and nevertheless to generate the required movement of the slide.

The use of a fixed barrel is in a certain contrast to intervention weapons with a drop barrel that are described in detail, for example, in U.S. Pat. Nos. 4,539,889 and/or 4,825,744 and/or 4,893,546. A breech (slide) with a fixed barrel is now intended to be placed onto the hand piece or handle pieces of weapons of this type or similarly designed weapons, by means of which the weapon becomes a practice weapon. The content of the documents mentioned is incorporated by reference into the content of the present application for the jurisdictions in which this is possible. In addition to pistols with a drop barrel, there are also pistols with a rotary barrel which, however, can be dealt with in a similar manner with respect to the invention.

In a refinement, it is provided to combine said lock with an adapter, wherein said adapter has a special run-on surface in the direction of the magazine for the next cartridge to be pushed into the chamber and thus eradicates the problems which repeatedly occur in the prior art especially with the drop barrel as a result of the height difference of barrel bore axis and magazine.

Figure 2:
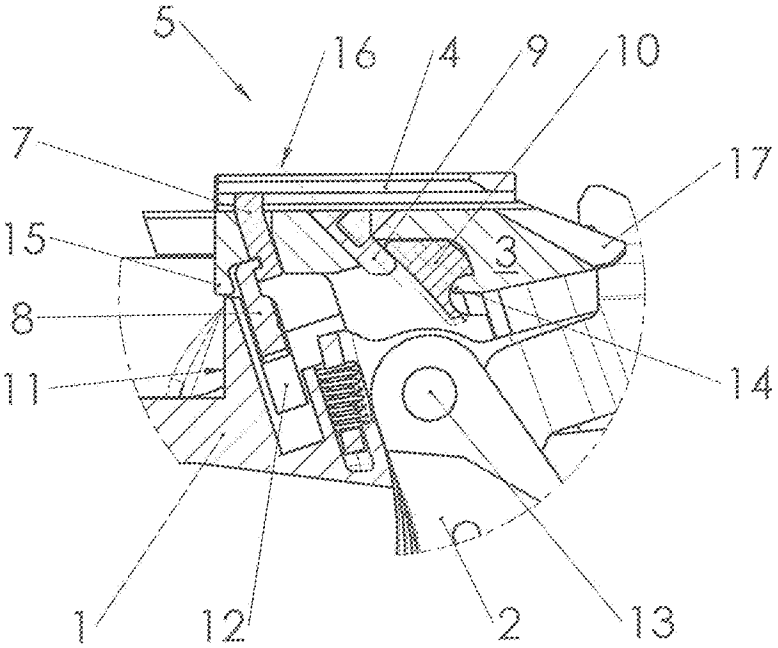
Figure 3:
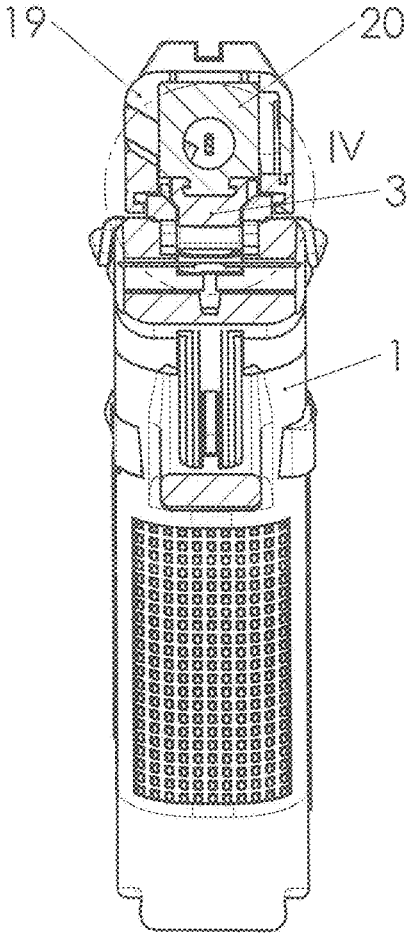
Figure 4:
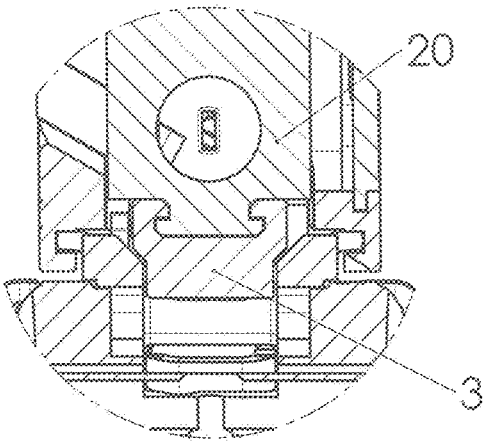
Figure 5:
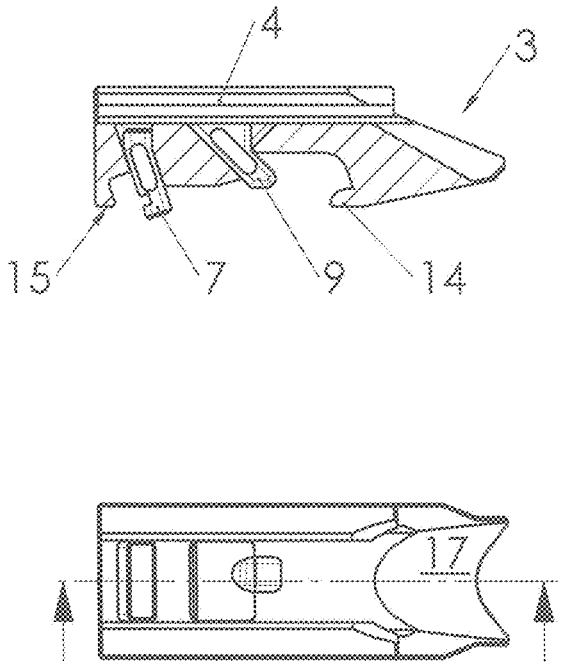
Figure 6:
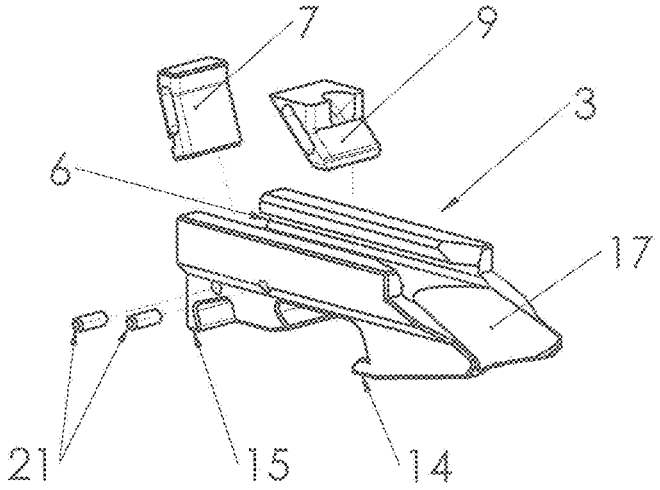

The invention is explained in more detail below with reference to the drawing, wherein the handle piece is considered to be a handle piece in accordance with the above-mentioned US patents, without the invention being restricted thereto. In the drawing:

FIG. 1 shows a schematic section through the handle piece of a pistol equipped according to the invention, FIG. 2 shows the detail II from FIG. 1, FIG. 3 shows a section along the line III-Ill from FIG. 1, FIG. 4 shows the detail IV from FIG. 3, FIG. 5 shows an adapter according to the invention in top view and in section, and FIG. 6 shows a perspective view of an adapter according to the invention together with lock, locking carriage and fastening pins.

In the description and the claims, the terms "front", "rear", "top", "bottom", "left", "right" and so on are used in the generally accepted form and with reference to a pistol which is held in a customary manner. That is to say that the nozzle of the barrel is "at the front", that the breech or slide is moved to "the rear" by the explosion gases, etc.

FIG. 1 shows a section through the plane of symmetry of a pistol designed according to the invention, or more precisely of its handle piece 1. A trigger mechanism 2 together with a trigger is included, and a shaft 18 for a magazine is illustrated. The essential details of the device according to the invention are illustrated in FIG. 2 which is an enlargement of the detail II from FIG. 1. It is apparent here that an adapter 3 is inserted into the handle piece 1, the upper region of which adapter is provided with guides 4 for the barrel and the front end region of the adapter, on the left in FIG. 2, has a locking slot 6 (FIG. 6) which runs virtually normally to the barrel axis 5 (only included in terms of its direction in FIG. 2).

A locking carriage 7 is arranged displaceably in the locking slot 6 and is operatively connected in an appropriate manner, via a groove and lug connection in the exemplary embodiment illustrated, to a lock 8. Said lock 8 is either the original lock for the barrel of the weapon when a conventional breech is used for shooting normal ammunition, or an adapted lock which is adapted firstly to the weapon and secondly to the adapter.

A further recess is provided in the adapter 3, making it possible to push a holding carriage 9 obliquely downward and rearward, in each case as seen with respect to the weapon, into the adapter. The shape of the holding carriage 9 can best be seen from FIG. 6, and the operation of the device is most clear from FIG. 2:

The handle piece 1 has various formations permitting the introduction and securing of the adapter 3: firstly there is a brace 10 which connects the two cheeks of the handle piece 1 to each other and mechanically braces same in this region above the trigger or the rotary bearing 13 thereof. Another component of this type is the base 11 on which the return spring rests and the upper region of which forms a supporting surface. Added to this is also the lock 8 and the associated slot 12 providing a further possibility for the introduction of an adapter 3. The compression springs, which are illustrated in the figures, in the region between the slot 12 and the rotary bearing 13 for the trigger are not of particular interest here. The securing now takes place as follows:

After the customary breech has been removed, the adapter 3 is pushed from the rear and top with its holding lug 14 under the brace 10 and is placed at the front with its support 15 onto the upper edge of the base 11. For the securing and the increase of the mechanical stability, the holding carriage 9 is then pushed in the push-in direction 16 into the slot provided therefore in the adapter 3 and surrounds the brace 10 on the other side, as does the holding lug 14, and therefore a mechanically stable design is produced.

If the training breech is then attached, the lock 8 is pulled downward in its slot 12 by the user counter to the force of a spring (not illustrated) and, by its lug/groove connection, carries along the locking carriage 7 downward, as a result of which the barrel together with the breech can be pushed in. If the lock 8 is then released, it passes together with the locking carriage 7 into the position illustrated in FIG. 2 and fixes the barrel, which has a notch at the appropriate point, on the guides 4. In an adapter, the barrel 20 secures the holding carriage 9 in its use position since it prevents the holding carriage from being displaced upward. Installation without the use of a tool is thereby made possible.

Furthermore, the rear end of the adapter 3 has a guide surface 17 which reaches as far as the edge of the magazine shaft 18 and ensures the easy supply, which can also be reliably provided with little force, of the next cartridge into the chamber. This is highly useful since the design of the edge of the magazine shaft is adapted to the position of the drop barrel when the next cartridge is pushed in. In the case of pistols with a rotary barrel, the provision of such a guide surface is of little if any importance.

FIG. 3 is a section along the line III-III from FIG. 1, but with the practice breech 19 attached and the practice barrel 20 inserted. The adapter 3 and its holder for the barrel 20 are clearly apparent.

This is even clearer in FIG. 4 which shows the detail III from FIG. 3.

FIGS. 5 and 6 firstly show the adapter 3 together with locking carriage 7 and holding carriage 9, in a top view and in a section along the plane of symmetry in FIG. 5, and in a perspective exploded illustration in FIG. 6, in which, in a Superplus variant, two fastening pins 21 are also provided which, given an appropriate design of the handle piece 1, can be used for fastening the adapter 3 in the handle piece. This signifies a Superplus variant because most handle pieces in existence are not provided with openings for such fastening pins as the fastening via the holding lug 14, the support 15 and the holding carriage 9 is sufficient in the case of weakly charged practice ammunition.

The invention is not limited to the illustrated and explained exemplary embodiment, and may be repeatedly modified. It is thus in particular possible and even necessary to adapt the device together with the adapter to the handle piece in each case under consideration (to the geometry thereof) and to the respective trigger mechanism (sliding trigger instead of rotatable trigger, etc.). Even if the adapter will practically always be provided with a guide surface 17 in order to ensure the supply of the next cartridge, this is not as essential as the securing of the position of the practice barrel by means of the guides 4. Whether the locking carriage 7 is designed and arranged as illustrated depends in turn greatly on the geometry of the handle piece under consideration; the same applies to an increased extent to the holding carriage 9 since the latter may be omitted under some circumstances, in particular if the support 15 has a corresponding shape and also under some circumstances interacts in a form-fitting manner with the lock 8.

The invention can therefore also be defined as follows: it relates to a practice weapon, comprising a conventional handle piece 1 with a lock 8 for a drop barrel or a rotary barrel, with a trigger mechanism 2 which optionally has a rotary bearing 13 for a rotatable trigger, with a spring base 11 on which the return spring is supported; and with a practice breech 19 with a fixed practice barrel 20.

The practice weapon, in order to achieve a conversion without using a tool is one wherein an adapter 3 is inserted into the handle piece 1, said adapter being supported firstly above the trigger mechanism 2, optionally above the rotary bearing 13, on a brace 10 of the handle piece 1 and secondly in the upper region of the spring base 11 of the handle piece 1, wherein the upper region of the adapter 3 has guides 4 for the practice barrel 20, and wherein the lock 8 interacts with a locking carriage 7 which is formed in a locking slot 6 of the adapter 3, and wherein the locking carriage 7 secures the practice barrel 20.

It should be emphasized as a further great advantage that it is not necessary to remove parts of the handle piece and to temporarily store them in any (always unpleasant) manner; only the "sharp" breech is removed, the adapter is inserted, the practice breech is attached and the conversion is finished. Of course, adapter and practice breech can be accommodated in an appropriate manner in a transport housing.

For safety reasons, the practice breech is preferably differentiated in a visually conspicuous manner (by color) from the sharp breech in order reliably to avoid confusion.

In summary, it can therefore be stated that the invention relates to a practice weapon, comprising a conventional handle piece (1) with a lock (8) for a drop barrel or a rotary barrel, with a trigger mechanism (2) which optionally has a rotary bearing (13) for a rotatable trigger, with a spring base (11) on which the return spring is supported; and with a practice breech (19) with a fixed practice barrel (20). According to the invention, this weapon is distinguished in that an adapter (3) is inserted into the handle piece (1), said adapter being supported firstly above the trigger mechanism (2), optionally above the rotary bearing (13), on a brace (10) and secondly in the upper region of the spring base (11) of the handle piece (1), wherein the upper region of the adapter (3) has guides (4) for the practice barrel (20), and wherein the lock (8) interacts with a locking carriage (7) which is formed in a locking slot (6) of the adapter (3), and wherein the locking carriage (7) secures the practice barrel (20).

LIST OF REFERENCE NUMBERS

01 handle piece
02 trigger mechanism
03 adapter
04 guides
05 barrel axis

06 locking slot
07 locking carriage
08 lock
09 holding carriage
10 brace
11 base
12 slot
13 rotary bearing
14 holding lug
15 support
16 push-in direction
17 guide surface
18 magazine shaft
19 practice breech
20 practice barrel
21 fastening pins

What is claimed:

1. A practice weapon, comprising:
a handle portion, the handle portion including
a lock for a drop barrel or a rotary barrel;
a trigger mechanism;
a brace; and
a spring base on which a return spring is supported; and
a practice breech having a fixed practice barrel;
wherein an adapter is inserted into the handle portion so that the adapter is supported firstly above the trigger mechanism on the brace and secondly in an upper region of the spring base of the handle portion;
an upper region of the adapter includes guides for the practice barrel; and
the lock is configured to interact with a locking carriage that is formed in a locking slot of the adapter, such that the locking carriage secures the practice barrel.

2. The practice weapon of claim 1, wherein the trigger mechanism includes a rotary bearing for a rotatable trigger.

3. The practice weapon of claim 2 wherein the adapter is supported above the rotary bearing.

4. The practice weapon of claim 1, wherein the adapter further includes a holding carriage that, in its user position, engages behind the brace or behind an adequate part of the handle portion and thereby secures the adapter in the handle portion in a form-fitting manner.

5. The practice weapon of claim 4, wherein the holding carriage is secured in its user position in the adapter by the practice barrel.

6. The practice weapon of claim 1 or claim 4, wherein the adapter has a rear portion, and the rear portion of the adapter includes a guide surface for cartridges to be supplied to the cartridge chamber.

7. The practice weapon of claim 1, wherein the adapter includes a holding lug that is configured to at least partially engage around the brace of the handle portion.

8. The practice weapon of claim 1, wherein the practice weapon is a practice firearm.

9. A practice pistol, comprising:
a handle portion, the handle portion including
a lock for a drop barrel or a rotary barrel;
a trigger mechanism;
a brace; and
a spring base on which a return spring is supported; and
a practice breech having a fixed practice barrel; and
an adapter that is coupled with the handle portion of the practice pistol above the trigger mechanism on the brace and in an upper region of the spring base, wherein the upper region of the adapter includes guides for the practice barrel, and a front end region of the adapter has a locking slot disposed substantially normally to an axis of the practice barrel; such that the lock for the barrel is configured to interact with a locking carriage displaceably disposed in the locking slot of the adapter, so that the locking carriage secures the practice barrel.

10. A method of converting a pistol into a training pistol, comprising:
inserting an adapter into a handle portion of the pistol, wherein the handle portion includes a barrel lock, a trigger mechanism, a brace, and a spring base on which a return spring is supported; and wherein the adapter includes an upper region defining guides for a practice barrel and a front end region defining a locking slot;
securing the adapter above the trigger mechanism on the brace and in the upper region of the spring base;
inserting a locking carriage into the locking slot of the adapter;
coupling the barrel lock with the locking carriage; and
securing a practice barrel with the locking carriage.

11. The method of claim 10, wherein inserting the adapter into the handle portion of the pistol includes inserting the adapter so that a guide surface at a rear end of the adapter is positioned to guide cartridges from a magazine of the pistol into a cartridge chamber of the pistol.

* * * * *